US009908252B2

(12) United States Patent
Lopez

(10) Patent No.: US 9,908,252 B2
(45) Date of Patent: Mar. 6, 2018

(54) FOOD CUTTING ASSEMBLY

(71) Applicant: Al Lopez, Bakersfield, CA (US)

(72) Inventor: Al Lopez, Bakersfield, CA (US)

( * ) Notice: Subject to any disclaimer, the term of this patent is extended or adjusted under 35 U.S.C. 154(b) by 20 days.

(21) Appl. No.: 15/130,670

(22) Filed: Apr. 15, 2016

(65) Prior Publication Data

US 2017/0297215 A1 Oct. 19, 2017

(51) Int. Cl.

| | |
|---|---|
| ***B26D 3/18*** | (2006.01) |
| ***B26D 1/09*** | (2006.01) |
| ***B26D 5/10*** | (2006.01) |
| ***B26D 7/18*** | (2006.01) |

(52) U.S. Cl.

CPC ..... *B26D 3/185* (2013.01); *B26D 1/09* (2013.01); *B26D 5/10* (2013.01); *B26D 7/1818* (2013.01)

(58) Field of Classification Search

CPC ..... B26D 3/18; B26D 3/185
USPC ..... 83/466.1, 564, 932; 99/567
See application file for complete search history.

(56) References Cited

U.S. PATENT DOCUMENTS 590,129 A * 9/1897 Bulette ..... B23P 5/00 76/101.1
608,368 A * 8/1898 Lawson ..... B26D 3/185 269/53
634,494 A 10/1899 Brinser
1,479,369 A * 1/1924 Chounis ..... B26D 3/185 83/425.3
1,588,479 A * 6/1926 Lopez ..... B26D 3/185 83/613
1,867,657 A * 7/1932 Dellinger ..... B26D 3/185 30/303
1,947,153 A * 2/1934 Dellinger ..... B26D 3/185 452/149
1,979,199 A 10/1934 Haynes
2,186,429 A 1/1940 Reinwald
2,245,978 A * 6/1941 Hyland ..... B26D 3/185 83/553
2,283,029 A * 5/1942 Bakewell ..... B26D 3/185 83/435.19
2,346,282 A * 4/1944 Watts ..... B26D 3/185 30/304
2,373,781 A * 4/1945 Richardson ..... B26D 3/185 100/226
2,374,851 A * 5/1945 Curtice ..... B26D 3/185 83/165
2,407,924 A * 9/1946 Garfunkel ..... B26D 3/185 248/224.61
4,062,260 A * 12/1977 Steinhogl ..... B26B 5/008 83/404.3
D280,690 S 9/1985 Bloxham
4,573,384 A * 3/1986 Jones ..... B26D 3/185 83/404.3

(Continued)

*Primary Examiner* — Ghassem Alie

(57) ABSTRACT

A food cutting assembly for cutting a food item into a plurality of cubes includes a stand that may be positioned on a support surface. A box is coupled to the stand and a drawer is slidably positioned within the box. A plurality of cutting units is provided. A selected one of the cutting units is removably coupled to the box. The selected cutting unit may have a food item placed thereon and the selected cutting unit selectively cuts the food item. A press is movably coupled to the stand. The press is urged downwardly toward the selected cutting unit to press the food item through the selected cutting unit. Thus, the selected cutting unit cuts the food item.

9 Claims, 6 Drawing Sheets

(56) References Cited

U.S. PATENT DOCUMENTS

| | | | | |
|---|---|---|---|---|
| 4,625,607 | A | 12/1986 | Maillez | |
| 5,245,902 | A * | 9/1993 | Pereira | B26D 3/185 83/425.3 |
| 5,303,472 | A * | 4/1994 | Mbanugo | B26B 27/00 241/95 |
| 6,558,244 | B1 | 5/2003 | Nedelka | |
| 7,568,414 | B2 * | 8/2009 | Farid | B26D 3/26 30/114 |
| 7,587,968 | B1 * | 9/2009 | Roberts | B26D 3/185 83/404.3 |
| 7,900,544 | B2 * | 3/2011 | Williams | B26D 3/185 83/404 |
| 7,992,476 | B2 | 8/2011 | Kaposi | |
| 8,495,941 | B2 * | 7/2013 | Farid | B26D 3/185 30/114 |
| 2012/0231717 | A1 * | 9/2012 | Zean | A22C 9/008 452/144 |

* cited by examiner

FOOD CUTTING ASSEMBLY

BACKGROUND OF THE DISCLOSURE

Field of the Disclosure

The disclosure relates to food cutting devices and more particularly pertains to a new food cutting device for cutting a food item into a plurality of cubes.

SUMMARY OF THE DISCLOSURE

An embodiment of the disclosure meets the needs presented above by generally comprising a stand that may be positioned on a support surface. A box is coupled to the stand and a drawer is slidably positioned within the box. A plurality of cutting units is provided. A selected one of the cutting units is removably coupled to the box. The selected cutting unit may have a food item placed thereon and the selected cutting unit selectively cuts the food item. A press is movably coupled to the stand. The press is urged downwardly toward the selected cutting unit to press the food item through the selected cutting unit. Thus, the selected cutting unit cuts the food item.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
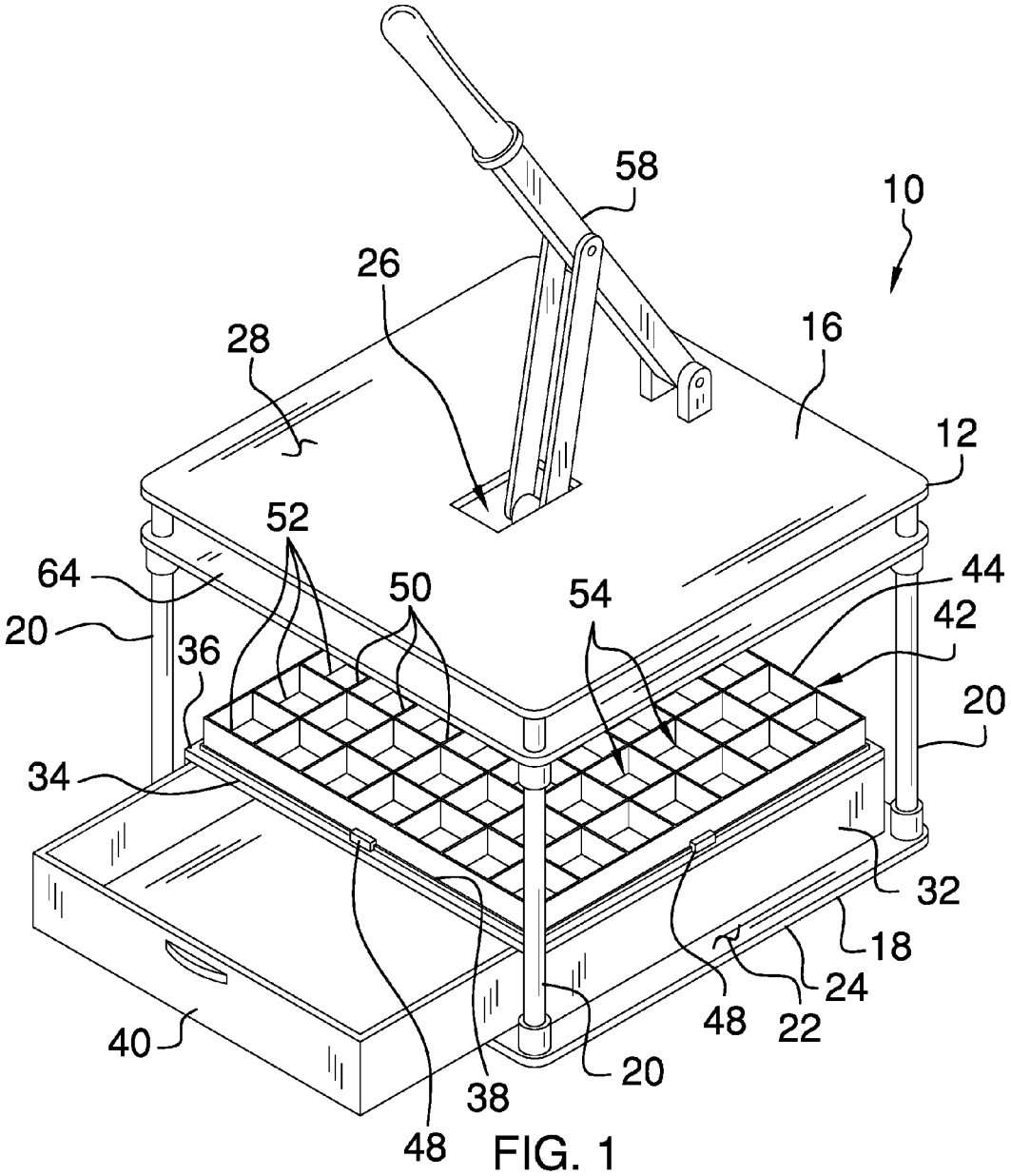
FIG. 1 is a top perspective view of a food cutting assembly according to an embodiment of the disclosure.
Figure 2:
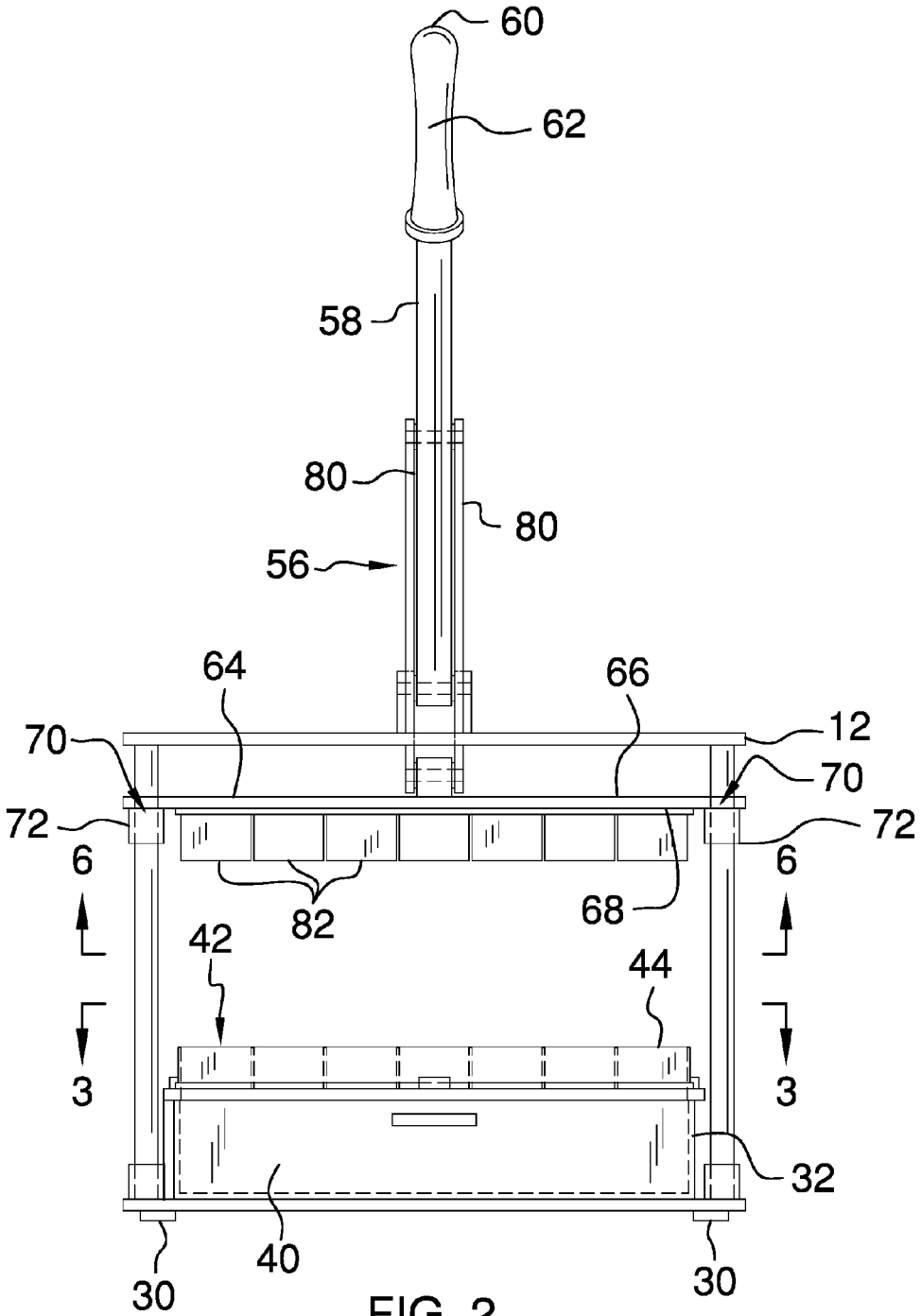
FIG. 2 is a front view of an embodiment of the disclosure.
Figure 3:
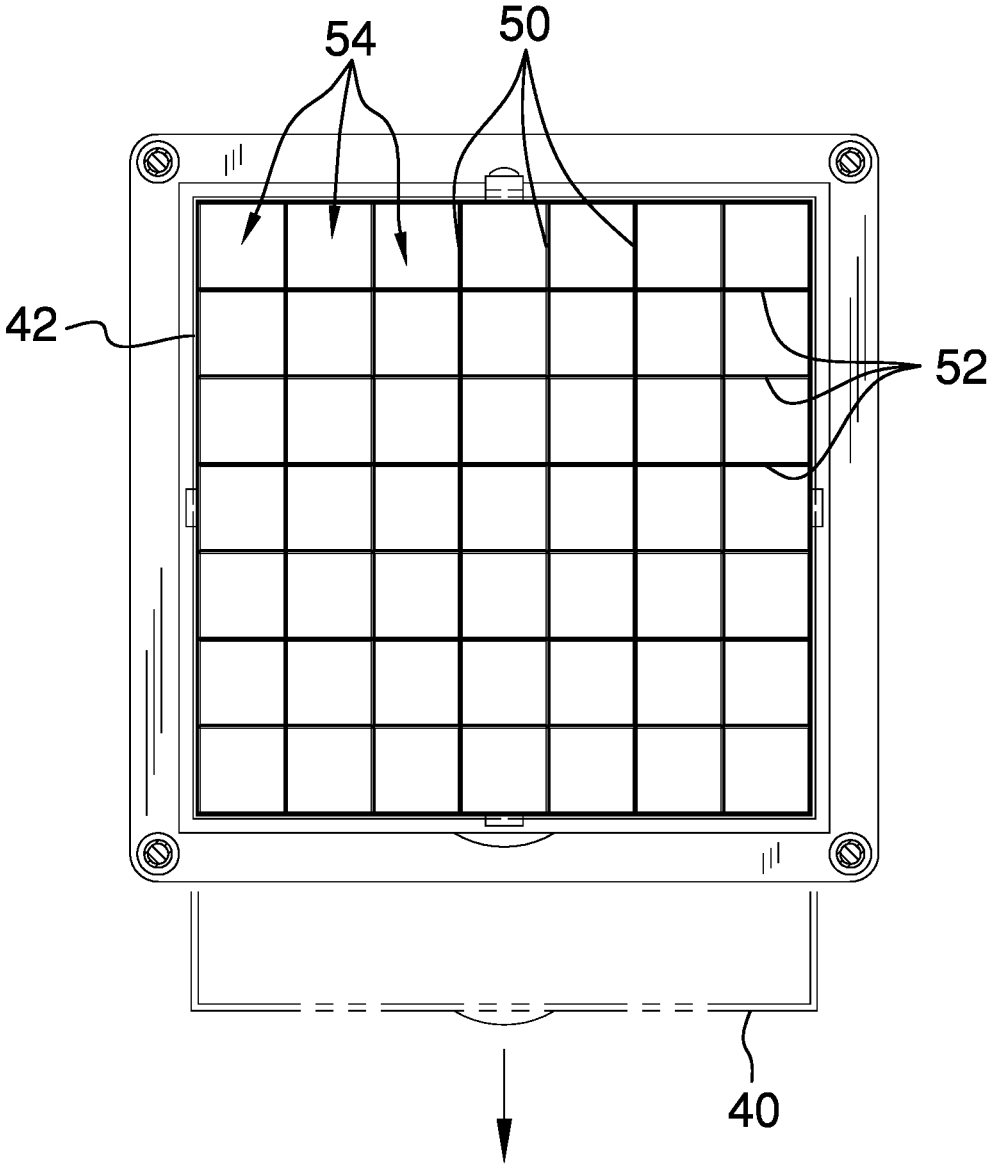
FIG. 3 is a cross sectional view taken along line 3-3 of FIG. 2 of an embodiment of the disclosure.
Figure 4:
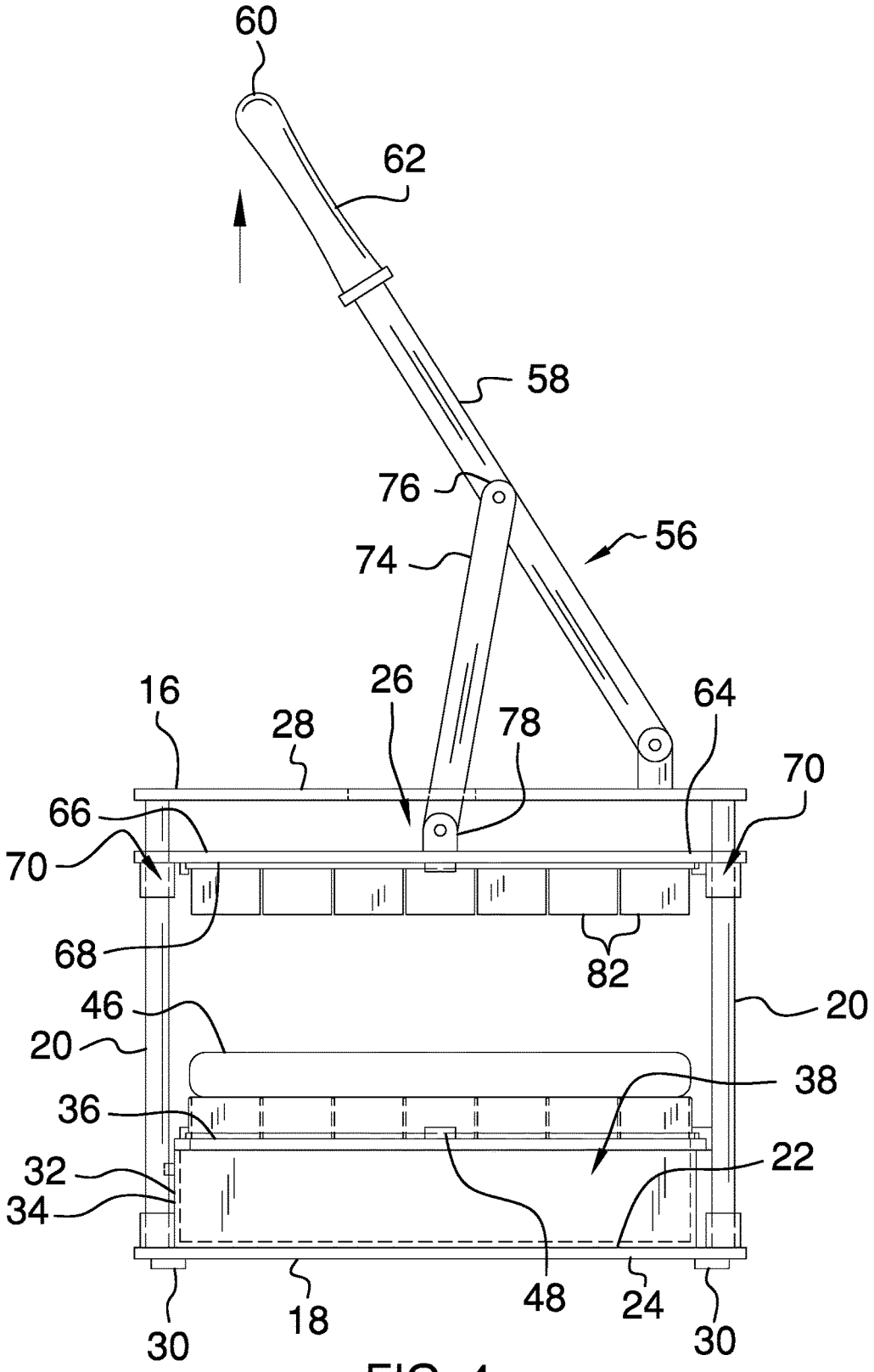
FIG. 4 is a left side view of an embodiment of the disclosure.
Figure 5:
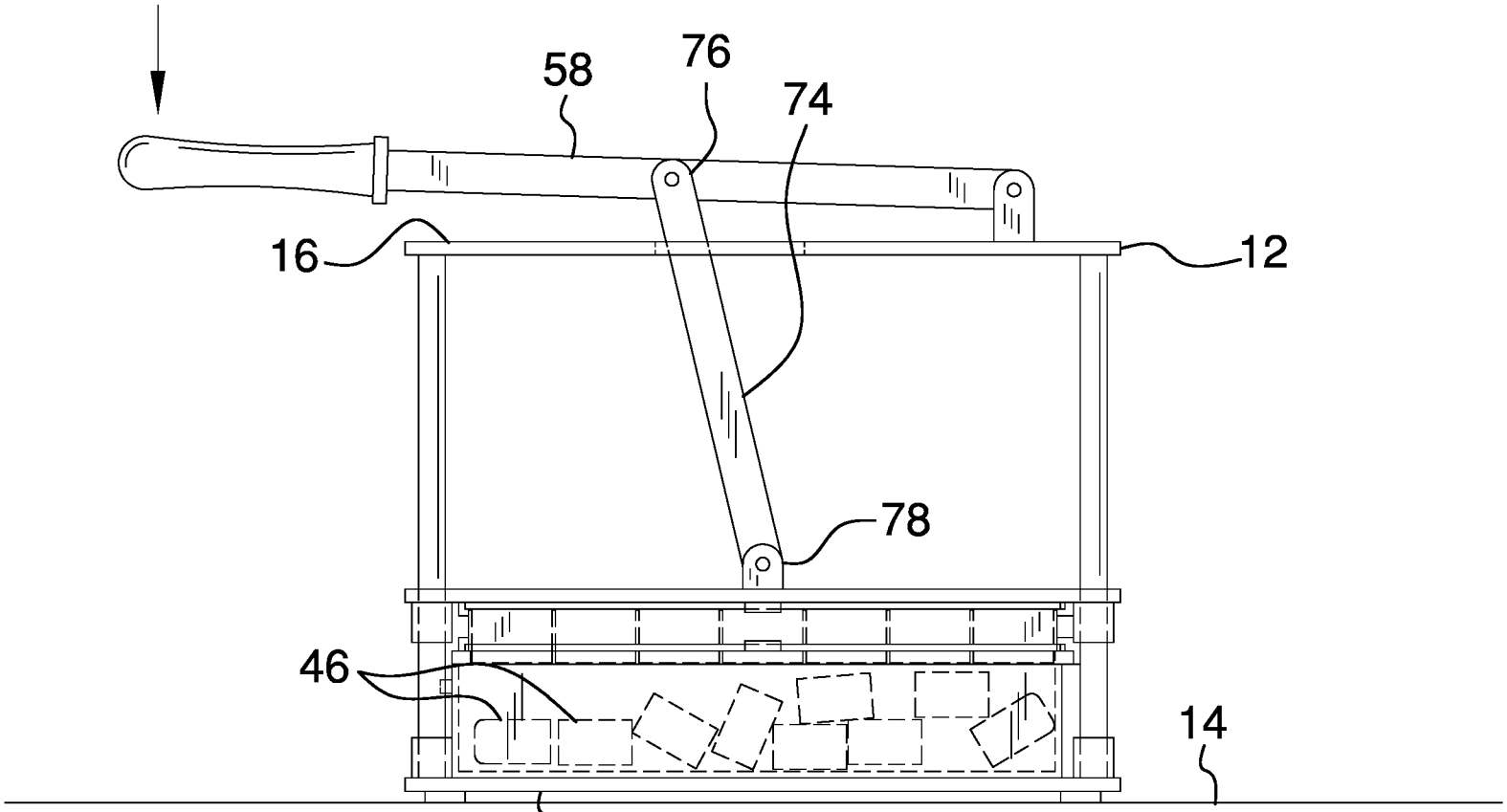
FIG. 5 is perspective in-use view of an embodiment of the disclosure
Figure 6:
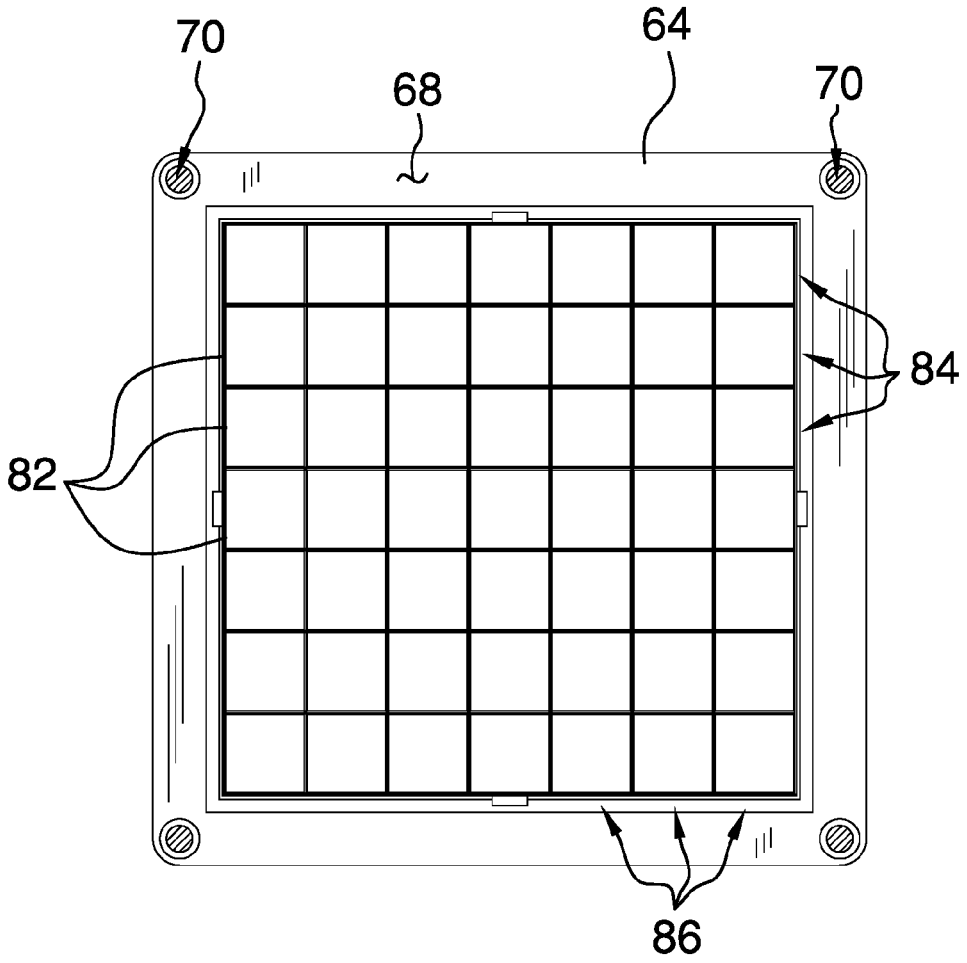
FIG. 6 is a cross sectional view taken along line 6-6 of FIG. 2 of an embodiment of the disclosure.

With reference now to the drawings, and in particular to FIGS. 1 through 6 thereof, a new press device embodying the principles and concepts of an embodiment of the disclosure and generally designated by the reference numeral 10 will be described.

As best illustrated in FIGS. 1 through 6, the food cutting assembly 10 generally comprises a stand 12 that may be positioned on a support surface 14. The support surface 14 may comprise a table or the like. The stand 12 includes a top platform 16, a bottom platform 18 and a plurality of legs 20. Each of the legs 20 extends between the top platform 16 and the bottom platform 18 such that the top platform 16 is spaced from the bottom platform 18.

The bottom platform 18 may be positioned on the support surface 14. The bottom platform 18 has a top surface 22 and a bottom surface 24. The top platform 16 has an opening 26 extending therethrough. The opening 26 is centrally positioned on the top platform 16 and the top platform 16 has an upper surface 28. A plurality of feet 30 may be provided and each of the feet 30 may be coupled to the bottom surface 24 of the bottom platform 18. Each of the feet 30 may abut the support surface 14 thereby supporting the stand 12 on the support surface 14.

A box 32 is provided and the box 32 is coupled to the stand 12. The box 32 is positioned on the top surface 22 of the bottom platform 18. The box 32 has a front side 34 and a top side 36, and the front side 34 is open. The top side 36 has an aperture 38 extending therethrough and the aperture 38 is substantially coextensive with the top side 36. A drawer 40 is slidably positioned within the box 32 and the drawer 40 is selectively extendable outwardly from the front side 34.

A plurality of cutting units 42 is provided. A selected one of the cutting units 42 is removably coupled to the box 32. The selected cutting unit 42 is positioned on the top side 36 of the box 32 and the selected cutting unit 42 surrounds the aperture 38 in the box 32. Each of the cutting units 42 has a top edge 44 and the top edge 44 corresponding to each of the cutting units 42 may have a food item 46 placed thereon. The food item 46 may comprise tripe or the like. The top edge 44 corresponding to each of the cutting units 42 is sharpened to selectively cut the food item 46.

A plurality of clips 48 may be provided and each of the clips 48 may be coupled to the top side 36 of the box 32. The clips 48 may be distributed around the aperture 38 in the box 32. Each of the clips 48 may engage the cutting unit 42. Thus, the selected cutting unit 42 may be removably retained on the box 32.

Each of the cutting units 42 comprises a plurality of lateral blades 50 and a plurality of longitudinal blades 52. The lateral blades 50 corresponding to each of the cutting units 42 are spaced apart from each other. The longitudinal blades 52 corresponding to each of the cutting units 42 are spaced apart from each other. The longitudinal blades 52 corresponding to each of the cutting units 42 intersect each of the lateral blades 50 corresponding to each of the cutting units 42 at a right angle. Thus, a plurality of openings 54 is defined in each of the cutting units 42. Each of the openings 54 corresponding to each of the cutting units 42 may have the food item 46 pass therethrough when the food item 46 is cut. Thus, the cut food item 46 is deposited in the drawer 40.

The plurality of cutting units 42 may comprise a first cutting unit, a second cutting unit and a third cutting unit. Each of the openings 54 corresponding to the first cutting unit may have a length and a width ranging between two cm and five cm. Each of the openings 54 corresponding to the second cutting unit may have a length and a width ranging between twelve mm and nineteen mm. Each of the openings 54 corresponding to the third cutting unit may have a length and a width ranging between six mm and twelve mm.

A press 56 is movably coupled to the stand 12 and the press 56 may be manipulated. The press 56 is urged downwardly toward the selected cutting unit 42 to press the food item 46 through the selected cutting unit 42. Thus, the selected cutting unit 42 cuts the food item 46. The press 56 comprises a handle 58 that is hingedly coupled to the upper surface 28 of the top platform 16. The handle 58 may be manipulated and the handle 58 has a distal end 60 with respect to the upper surface 28. A grip 62 may be coupled to the handle 58. The grip 62 may extend from the distal end 60 of the handle 58 toward the top platform 16 and the grip 62 may be gripped.

A plate 64 is provided that has a topmost surface 66 and a bottommost surface 68. The plate 64 has a plurality of holes 70 extending through the topmost surface 66 and the bottommost surface 68. Each of the holes 70 has an associated one of the legs 20 extending therethrough. Thus, the plate 64 is slidably positioned between the top platform 16 and the bottom platform 18. A plurality of sleeves 72 may each be coupled to the bottommost surface 68 of the plate 64. Each of the sleeves 72 may have an associated one of the legs 20 extending therethrough.

A linkage 74 is provided that has a first end 76 and a second end 78. The first end 76 is hingedly coupled to the handle 58. The first end 76 is positioned at a point is centrally located on the handle 58. The linkage 74 extends though the opening 26 in the top platform 16 and the second end 78 is hingedly coupled to the topmost surface 66 of the plate 64.

A pair of the linkages 80 may be provided. Each of the pair of linkages 80 may be positioned on opposite sides of the handle 58. The handle 58 is urgeable into a pressing position having the plate 64 being urged downwardly toward the bottom platform 18. The handle 58 is urgeable into a releasing position having the plate 64 being urged upwardly toward the top platform 16.

A plurality of cubes 82 is provided and each of the cubes 82 is coupled to the bottommost surface 68 of the plate 64. The cubes 82 are spaced apart from each other and are distributed on the bottommost surface 68. The cubes 82 are arranged into a plurality of rows 84 and columns 86 on the bottommost surface 68. Each of the cubes 82 is aligned with an associated one of the openings 54 in the selected cutting unit 42. Each of the cubes 82 compresses the food item 46 through each of the openings 54 in the cutting unit 42 when the handle 58 is urged into the pressing position. Thus, the food item 46 is cut into a plurality of cubes of food item 46.

In use, the food item 46 is placed on the top edge 44 of the cutting unit 42. The handle 58 is urged into the pressing position. The cubes 82 press the food item 46 through each of the openings 54 in the cutting unit 42. Each of the longitudinal blades 52 and the lateral blades 50 cuts the food item 46 as the cubes 82 press the food item 46. The food item 46 is cut into a plurality of cubes of food item 46. The cubes of food item 46 are deposited into the drawer 40. The drawer 40 is extended outwardly from the box 32 and the cubes of food 46 item are retrieved.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A food cutting assembly being configured to cut a food item into a plurality of squares, said assembly comprising:

a stand being configured to be positioned on a support surface, said stand including a top platform, a bottom platform and a plurality of legs, each of said legs extending between said top platform and said bottom platform such that said top platform is spaced from said bottom platform, said bottom platform being configured to be positioned on the support surface, said bottom platform having a top surface, said top platform having an opening extending therethrough, said opening being centrally positioned on said top platform, said top platform having an upper surface;

a box being coupled to said stand;

a drawer being slidably positioned within said box;

a plurality of cutting units, a selected one of said cutting units being removably coupled to said box, said selected cutting unit being configured to have a food item placed thereon wherein said selected cutting unit is configured to selectively cut the food item; and a press being movably coupled to said stand wherein said press is configured to be manipulated, said press being urged downwardly toward said selected cutting unit wherein said press is configured to press the food item through said selected cutting unit thereby facilitating said selected cutting unit to cut the food item, said press including a handle, said handle being straight and elongated having a first end being hingedly coupled to said upper surface of said top platform offset from said opening, said handle having a distal end with respect to said upper surface, said press including a linkage having a first end and a second end, said first end being hingedly coupled to said handle, said linkage extending though said opening in said top platform, said press including a plate coupled to said second end of said linkage wherein said plate is positioned under and covered by said top platform.

2. The assembly according to claim 1, wherein said box is positioned on said top surface of said bottom platform, said box having a front side and a top side, said front side being open, said top side having an aperture extending therethrough.

3. The assembly according to claim 2, wherein said selected cutting unit is positioned on said top side of said box such that said selected cutting unit surrounds said aperture in said box, each of said cutting units having a top edge, said top edge corresponding to each of said cutting units being configured to have a food item being placed thereon, said top edge corresponding to each of said cutting units being sharpened wherein each of said cutting units is configured to selectively cut the food item.

4. The assembly according to claim 3, wherein each of said cutting units comprises a plurality of lateral blades and a plurality of longitudinal blades, said lateral blades being spaced apart from each other, said longitudinal blades being spaced apart from each other, said longitudinal blades intersecting each of said lateral blades at a right angle to define a plurality of openings in each of said cutting units wherein each of said openings corresponding to each of said cutting units is configured to have the food item pass therethrough when the food item is cut thereby facilitating the cut food item to be deposited in said drawer.

5. The assembly according to claim 1, further comprising a plate having a topmost surface and a bottommost surface, said plate having a plurality of holes extending therethrough, each of said holes having an associated one of said legs extending therethrough such that said plate is slidably positioned between said top platform and said bottom platform.

6. The assembly according to claim 5, further comprising said first end of said linkage being positioned at a point being centrally located on said handle, said second end being hingedly coupled to said topmost surface of said plate.

7. The assembly according to claim 6, wherein said handle is urgeable into a pressing position having said plate being urged downwardly toward said bottom platform, said handle being urgeable into a releasing position having said plate being urged upwardly toward said top platform.

8. The assembly according to claim 7, further comprising:

said cutting unit having a plurality of openings; and a plurality of cubes, each of said cubes being coupled to said bottommost surface of said plate, said cubes being spaced apart from each other and distributed on said bottommost surface, said cubes being arranged into a plurality of rows and columns on said bottommost surface such that each of said cubes is aligned with an associated one of said openings in said selected cutting unit, each of said cubes being configured to compress the food item through each of said openings in said selected cutting unit when said handle is urged into said pressing position thereby facilitating the food item to be cut into a plurality of cubes.

9. A food cutting assembly being configured to cut a food item into a plurality of squares, said assembly comprising:

a stand being configured to be positioned on a support surface, said stand comprising a top platform, a bottom platform and a plurality of legs, each of said legs extending between said top platform and said bottom platform such that said top platform is spaced from said bottom platform, said bottom platform being configured to be positioned on the support surface, said bottom platform having a top surface, said top platform having an opening extending therethrough, said opening being centrally positioned on said top platform, said top platform having an upper surface;

a box being coupled to said stand, said box being positioned on said top surface of said bottom platform, said box having a front side and a top side, said front side being open, said top side having an aperture extending therethrough;

a drawer being slidably positioned within said box, said drawer being selectively extendable outwardly from said front side;

a plurality of cutting units, a selected one of said cutting units being removably coupled to said box, said selected cutting unit being positioned on said top side of said box such that said selected cutting unit surrounds said aperture in said box, each of said cutting units having a top edge, said top edge corresponding to each of said cutting units being configured to have a food item being placed thereon, said top edge corresponding to each of said cutting units being sharpened wherein each of said cutting units is configured to selectively cut the food item, each of said cutting units comprising a plurality of lateral blades and a plurality of longitudinal blades, said lateral blades corresponding to each of said cutting units being spaced apart from each other, said longitudinal blades corresponding to each of said cutting units being spaced apart from each other, said longitudinal blades corresponding to each of said cutting units intersecting each of said lateral blades corresponding to each of said cutting units at a right angle to define a plurality of openings in each of said cutting units wherein each of said openings corresponding to each of said cutting units is configured to have the food item pass therethrough when the food item is cut thereby facilitating the cut food item to be deposited in said drawer; and a press being movably coupled to said stand wherein said press is configured to be manipulated, said press being urged downwardly toward said selected cutting unit wherein said press is configured to press the food item through said selected cutting unit thereby facilitating said selected cutting unit to cut the food item, said press comprising:

a handle, said handle being straight and elongated having a first end being hingedly coupled to said upper surface of said top platform offset from said opening, said handle having a distal end with respect to said upper surface, a plate having a topmost surface and a bottommost surface, said plate having a plurality of holes extending therethrough, each of said holes having an associated one of said legs extending therethrough such said plate is slidably positioned between said top platform and said bottom platform, a linkage having a first end and a second end, said first end being hingedly coupled to said handle, said first end being positioned at a point being centrally located on said handle, said linkage extending though said opening in said top platform, said second end being hingedly coupled to said topmost surface of said plate wherein said plate is positioned under and covered by said top platform, said handle being urgeable into a pressing position having said plate being urged downwardly toward said bottom platform, said handle being urgeable into a releasing position having said plate being urged upwardly toward said top platform, and a plurality of cubes, each of said cubes being coupled to said bottommost surface of said plate, said cubes being spaced apart from each other and distributed on said bottommost surface, said cubes being arranged into a plurality of rows and columns on said bottommost surface such that each of said cubes is aligned with an associated one of said openings in said selected cutting unit, each of said cubes being configured to compress the food item through each of said openings in said selected cutting unit when said handle is urged into said pressing position thereby facilitating the food item to be cut into a plurality of cubes.

* * * * *